United States Patent [19]

Shoptaugh

[11] Patent Number: 5,042,808

[45] Date of Patent: Aug. 27, 1991

[54] LABYRINTH TOY

[76] Inventor: Philip L. Shoptaugh, 5860 Buena Vista Ave., Oakland, Calif. 94618

[21] Appl. No.: 448,930

[22] Filed: Dec. 12, 1989

[51] Int. Cl.[5] ..... A63F 7/00

[52] U.S. Cl. ..... 273/110

[58] Field of Search ..... 273/110, 113

[56] References Cited

U.S. PATENT DOCUMENTS

| | | | |
|---|---|---|---|
| 2,060,797 | 11/1936 | Chambers | 273/110 |
| 3,384,374 | 5/1968 | Boothe | 273/110 |
| 3,751,038 | 8/1973 | O'Keefe | 273/110 |
| 3,787,055 | 1/1974 | Kraemer | 273/110 |
| 3,815,917 | 6/1974 | Brown | 273/110 |
| 3,858,883 | 1/1975 | Fabricant | 273/110 |
| 3,931,972 | 1/1976 | Fabian | 273/110 |
| 4,023,806 | 5/1977 | Wiser | 273/110 |
| 4,070,025 | 1/1978 | Wiser | 273/110 |
| 4,118,031 | 10/1978 | Westbrook | 273/110 |
| 4,143,875 | 3/1979 | Browning et al. | 273/110 |

OTHER PUBLICATIONS

"Playthings", Oct. 1977, p. 64.

*Primary Examiner*—Edward M. Coven
*Assistant Examiner*—Raleigh W. Chiu
*Attorney, Agent, or Firm*—Harris Zimmerman

[57] ABSTRACT

A toy comprises a body member and a handle member, the body member having an outer member pivotally movable in use about a horizontal axis, and an inner member rotatably supported relative to the outer member, the inner member incorporating a playing surface along which a ball travels, wherein the handle member is connected to the inner member, and wherein the handle member and connected inner member is in engagement with the outer member, such that lifting and lowering movement of the handle will pivot the outer member about its horizontal axis, and rotational movement of the handle will rotate the inner member relative to the outer member, in order to control inclination of the playing surface.

13 Claims, 2 Drawing Sheets

LABYRINTH TOY

BACKGROUND OF THE INVENTION

This invention relates to a toy, and in particular a toy which is used to control a ball on a playing surface.

Enclosed shaped toys are known which are handheld for controlling a ball on a playing surface. These arrangements, since they are handheld, are difficult for young children to use, since it requires precise manipulation. Furthermore, since precise manipulation is required, the design of the playing surface on which the ball travels has to be relatively simple.

A further game is known, which is mounted for instance on a table, and in which a ball is fired along the playing surface in order to score points by falling into holes or like in the playing surface. This toy arrangement provides little control, since once the ball is fired, no further control of the ball can be achieved.

Finally, another game known as a Labyrinth game is known, which comprises a ball playing surface mounted within a box member, the playing surface being controlled about two horizontal axes (at right angles to each other) by separate control mechanisms in order to control the movement of a ball on the playing surface. Since there are two control mechanisms, a player of the game has to use both hands in order to manipulate the ball on the playing surface, and in practice this requires precise manipulation and makes the game difficult to play, and in particular to control the movement of the ball on the playing surface.

SUMMARY OF THE INVENTION

In accordance with the invention, a toy comprises a body member and a handle member, the body member having an outer member pivotally movable in use about a horizontal axis, and an inner member rotatably supported relative the outer member, the inner member incorporating a playing surface along which a ball travels, wherein the handle member is connected to the inner member, and wherein the handle member and connected inner member is in engagement with the outer member, such that lifting and lowering movement of the handle will pivot the outer member about its horizontal axis, and rotational movement of the handle will rotate the inner member relative the outer member, in order to control inclination of the playing surface.

In such an arrangement, the user of the game has a single point of control, in other words with one hand the user of the game can completely control the movement of a ball on the playing surface. In particular, the rotatable movement of the inner member relative the outer member (which is itself pivotably supported about a horizontal axis) gives the user of the toy extremely precise manipulation of a ball on the playing surface provided in the inner member. In particular, the user of the toy can control the movement of the playing surface by simply holding the handle and firstly rotatably moving and/or secondly lifting/lowering the handle as appropriate. Such allows the toy to have a complicated maze/labyrinth type arrangement on the playing surface, thereby making the toy interesting and challenging.

In particular, lifting/lowering of the handle and rotating of the wrist simultaneously controls both axes with a single arm/wrist movement. This creates a totally different type of skill requirement to that required in prior art arrangements. The ratio of lifting or lowering to the degree of wrist rotation varies depending on the desired path of the ball. The attitude/level of the playing surface must respond exactly and precisely as directed by control of the handle, since there are no intermediary mechanics between the user's hand movement and the playing surface. The response is absolute and the playing surface must respond (like a tennis racquet) according to the player's wishes. This provides a much greater degree of ball control accuracy and sensitivity.

Suitably, the inner member is rotatably supported about an axis which intersects at right angles the pivotable axis of the outer member.

Suitably, support means are provided to support the outer member of the body member relative a supporting surface. This supporting surface can be for instance a table, or indeed any surface which can be up to say 10° from the vertical. Alternatively, the outer member is itself adapted to provide support for the toy, and in particular the underside of the outer member is shaped such that it can stand on a supporting surface (like a table) in order that the user can control the toy on that supporting surface.

The provision of the inner member being rotatable about an axis (generally horizontal), together with the feature of the handle being liftable up and down in a vertical plane about a horizontal axis, and finally the inherent support given to the inner member due to its mounting relative the outer member (which is itself supported either by a fixed support means, or alternatively directly on a supporting surface), provides the user with the possibility of precise manipulation of the toy.

Suitably, the playing surface is provided with a number of obstacles such as holes or bars mounted thereon, whereby the game consists of moving a ball on the playing surface through a defined path (such as a maze) in order to reach a predetermined destination.

Suitably, the playing surface is mounted within the inner member, and in particular ledge means are provided on the inner portion of the inner member, such that the playing surface can be simply placed thereon.

Suitably, the toy is provided with a plurality of playing surfaces, such that a number of different maze/labyrinth can be attempted by simply removing one playing surface and replacing it with another playing surface having a different "obstacle course" thereon.

Suitably, two of the playing surfaces can be a simple playing surface for use by a child, and a complicated playing surface with numerous holes and bars (and even ramps) for elder users of the toy.

BRIEF DESCRIPTION OF THE DRAWING

The invention will now be described by way of example with reference to the accompanying drawing, in which.

DESCRIPTION OF THE PREFERRED EMBODIMENTS

Figure 1:
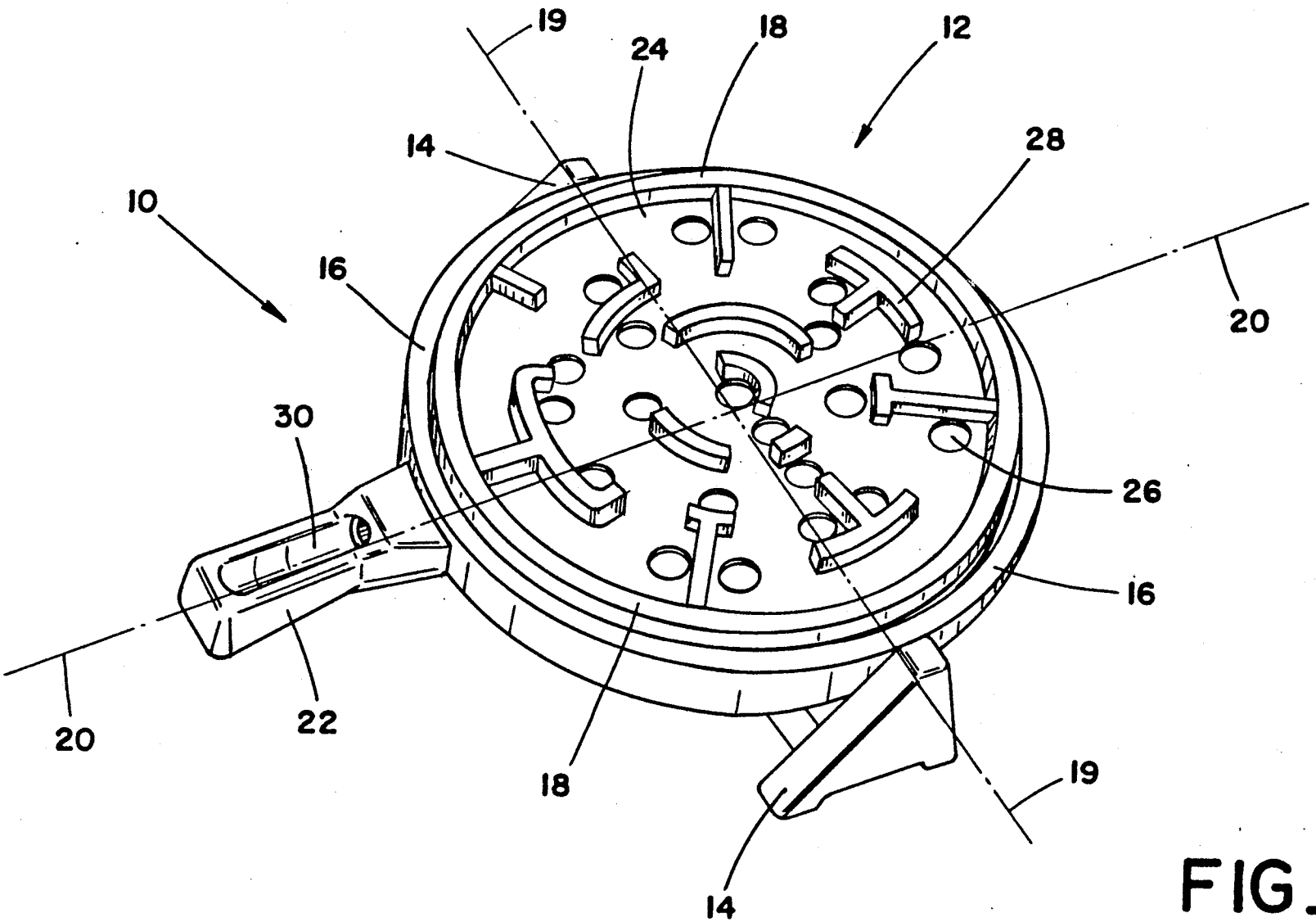
FIG. 1 shows a perspective view of a toy in accordance with the invention.

In FIG. 1, a toy 10 is shown having a body member 12 supported by support means 14.

The body member 12 comprises an outer ring member 16, and an inner member 18 supported within the outer ring.

The support means 14 fixedly mount the outer ring member 16 about a generally horizontal axis 19, and in turn the outer member 16 rotatably supports the inner member 18 about a further axis 20 (which is generally horizontal), and which axis 20 intersects the outer ring support axis 19 at right angles thereto.

The inner member 18 is integrally connected to a handle member 22 along the rotating axis 20 of the inner member.

The arrangement is such that the inner member 18 can be rotated about its axis 20 within the outer ring 16 by rotational movement of the handle member 22 to which the inner member is integrally fixed. Furthermore, the inner member 18 and outer member 16 can be moved up and down about the pivotable axis 19 of the outer ring by upward and downward movement of the handle member 22 by the user.

This combined rotatable/pivotable movement about two axis which intersect each other at right angles, gives the user of the toy extremely precise manipulation of a ball on a playing surface 24 within the inner member, particularly since inherent support is given to the whole arrangement because the outer ring is supported about the horizontal axis 19 by the support means 14.

Suitably, the playing surface 24 within the inner member is provided with a plurality of holes 26 and obstacle members such as bars 28 and/or ramps, whereby the playing surface provides "a maze/labyrinth type" game.

Due to the circular design, the playing surface 24 may be rotated within the inner member 18 into an infinite number of playing positions providing greater variety. If the player becomes too accustomed to one position, he simply rotates the disc to another position.

Figure 2:
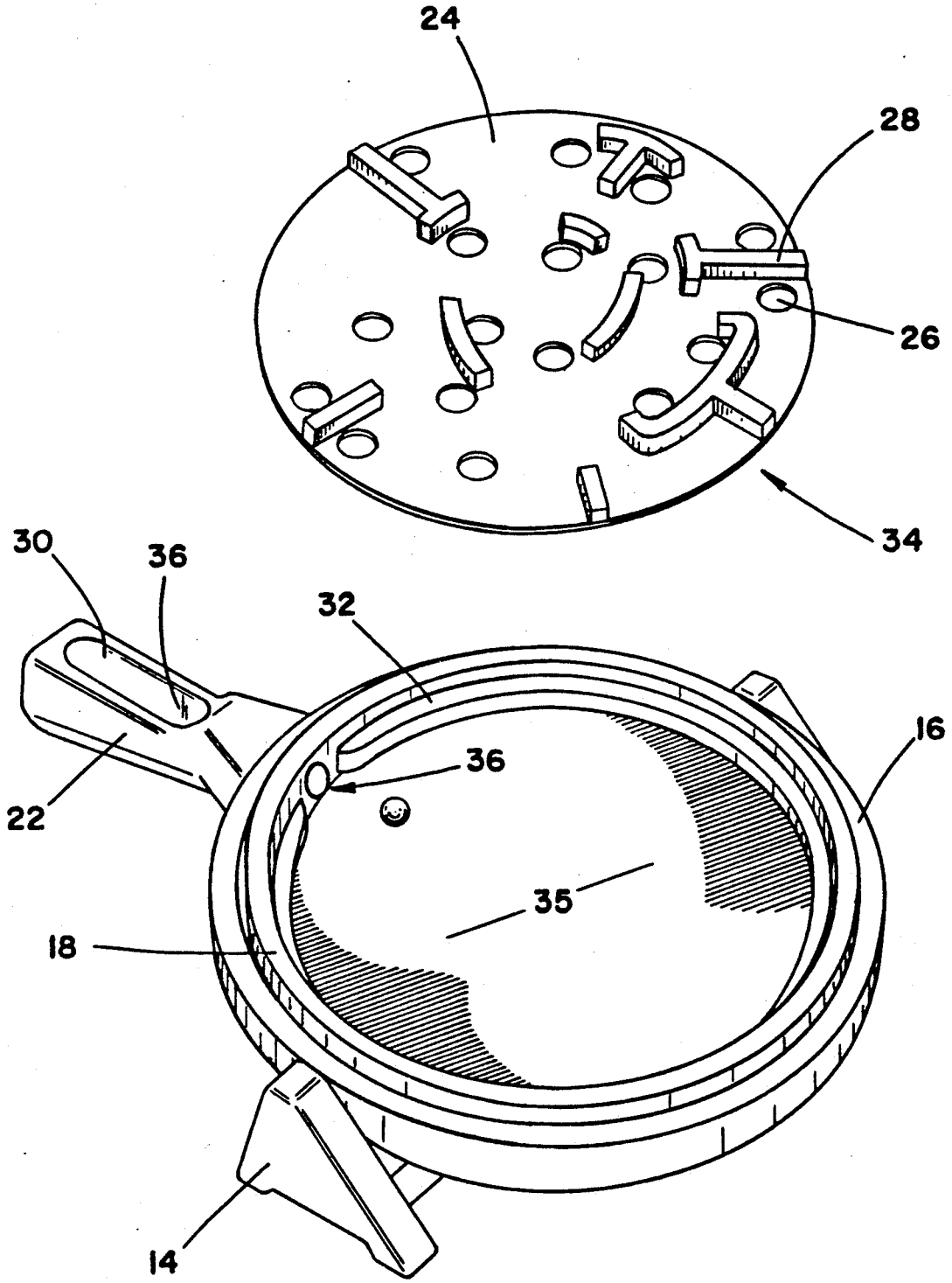
FIG. 2 shows an exploded perspective view of the toy illustrated in FIG. 1.

In order to mount the playing surface 24 within the inner member, a ledge 32 (see FIG. 2) is provided along the inner part of the inner member 18. The playing surface is removable, and another playing surface 34 (see FIG. 2) can be positioned therein instead. In consequence, the toy can be used by a child with say a simple maze type arrangement on one playing surface, and yet the toy can be used by an adult by using a further playing surface having a complicated maze arrangement thereon.

Suitably, the arrangement is such that the playing surface 24 is mounted on the ledge 32 above the bottom surface 35 of the inner member 16, a distance slightly greater than the diameter of the ball used with the toy, such that when a ball falls into a hole 26 in the playing surface, the ball will roll underneath the playing surface, and on the bottom surface of the inner member, down into the handle member 22 for further use. In this regard, a ball collecting chamber 30 is provided in the handle, and a connecting passageway 36 is also provided from the ball collecting chamber of the handle (through the connecting pivot point of the inner member to the outer member, in other words along the rotational axis of the inner member) to the space beneath the playing surface and in the inner member (i.e. the interior of the inner member).

It is envisaged that the toy (which could be a plaything or game) could be of any size ranging from between a few centimeters to even a few meters in length. Furthermore, it is envisaged that each of the playing surfaces could have a playing surface on each side, which only one of which of course will be used at any one time. It is also envisaged that a toy could be formed having multiple layers of playing surfaces, on which a ball could be moved therebetween by a player. In particular, ramps could also be provided between two layers of playing surfaces such that a ball could be transferred from one surface to another.

I claim:

1. A toy comprising a body member a handle member, and a ball, the body member having an outer member pivotally movable in use about a horizontal axis, and an inner member freely and rotatably supported relative the outer member, the inner member incorporating a playing surface along which said ball travels, wherein the handle member is connected to the inner member, and wherein the handle member and connected inner member are in engagement with the outer member, such that lifting and lowering movement of the handle member will pivot the outer member about its horizontal axis, and rotational movement of the handle member will rotate the inner member relative the outer member without rotation of the outer member, in order to control inclination of the playing surface.

2. A toy as claimed in claim 1 wherein the playing surface is provided with a number of obstacles past which said ball on the playing surface must follow a defined path in order to reach a predetermined destination.

3. A toy as claimed in claim 1 wherein support means are provided to support the outer member relative a supporting surface.

4. A toy as claimed in claim 1 wherein the outer member is adapted to provide support for the toy.

5. A toy as claimed in claim 4 wherein the underside of the outer member is shaped such that it can stand on a supporting surface.

6. A toy as claimed in claim 1 wherein the playing surface is provided with a number of obstacles whereby the game consists of moving a ball on the playing surface through a defined path in order to reach a predetermined destination.

7. A toy as claimed in claim 2 wherein an inner portion of the inner member is provided with ledge means, such that the playing surface can be supported thereon.

8. A toy as claimed in claim 1 wherein the toy is provided with a plurality of playing surfaces.

9. A toy as claimed in claim 1 wherein the handle member incorporates a chamber interconnected to the interior of the inner member.

10. A toy as claimed in claim 9 wherein an interconnecting passageway is provided between the chamber and the interior of the inner member.

11. A toy as claimed in claim 1 wherein the handle member is integral with the inner member.

12. A toy as claimed in claim 1 wherein the handle member and connected inner member pass through the outer member to be in engagement therewith.

13. A toy comprising a body member, a handle member, and a ball, the body member having an outer member pivotally movable in use about a horizontal axis, and an inner member freely and rotatably supported relative the outer member, the inner member incorporating a playing surface along which said ball travels, wherein the handle member is connected to the inner member, wherein the handle member and connected inner member are in engagement with the outer member, such that lifting and lowering movement of the handle member will pivot the outer member about its horizontal axis, and rotational movement of the handle member about a rotational axis will rotate the inner member relative the outer member without rotation of the outer member, in order to control inclination of the playing surface, and wherein an interconnecting passageway is provided along the rotational axis of the handle and inner members to connect a chamber provided in the handle member with the interior of the inner member.

* * * * *